US005285618A

United States Patent [19]

Bernhard

[11] Patent Number: 5,285,618

[45] Date of Patent: Feb. 15, 1994

[54] APPARATUS FOR SEPARATING AND MAKING AVAILABLE CLOSURE ELEMENTS

[75] Inventor: Herbert Bernhard, Wolfsheim, Fed. Rep. of Germany

[73] Assignee: Seitz Enzinger Noll Maschinenbau Aktiengesellschaft, Mannheim, Fed. Rep. of Germany

[21] Appl. No.: 969,015

[22] Filed: Oct. 30, 1992

[30] Foreign Application Priority Data

Nov. 6, 1991 [DE] Fed. Rep. of Germany ..... 4136464

[51] Int. Cl.[5] ..... B67B 3/064; B65B 7/28

[52] U.S. Cl. ..... 53/308; 53/343

[58] Field of Search ..... 53/308, 306, 343

[56] References Cited

U.S. PATENT DOCUMENTS

| | | | |
|---|---|---|---|
| 1,350,405 | 8/1920 | Gaynor | 53/343 X |
| 2,695,124 | 11/1954 | Mulligan | 53/343 X |
| 2,721,020 | 10/1955 | Meyer | 53/343 X |
| 2,925,797 | 2/1960 | Diezel et al. | 53/308 X |
| 3,269,514 | 8/1966 | Daniels et al. . | |
| 3,600,874 | 8/1971 | Noguchi | 53/306 |
| 3,643,398 | 2/1972 | Quest et al. | 53/306 X |
| 3,683,588 | 8/1972 | Ahlers | 53/308 X |
| 3,714,760 | 2/1973 | Roberts et al. | 53/308 X |
| 3,771,283 | 11/1973 | Over et al. | 53/343 X |
| 4,559,759 | 12/1985 | Herbert | 53/308 |

FOREIGN PATENT DOCUMENTS

| | | |
|---|---|---|
| 2734599 | 8/1977 | Fed. Rep. of Germany . |
| 2109824 | 5/1972 | France . |
| 2294090 | 12/1975 | France . |

*Primary Examiner*—Horace M. Culver
*Attorney, Agent, or Firm*—Robert W. Becker & Associates

[57] ABSTRACT

An apparatus for separating and making available crown corks or similar closure elements. The apparatus has a wheel that rotates about a vertical axis. The wheel is provided with carrier members that project radially beyond a periphery of the wheel and are disposed over a support surface. The carrier members successively move closure elements that rest on the support surface from a transfer position formed at the end of a closure channel to a receiving position, where a respectively available closure element is picked up and carried along by a closing mechanism of a closing machine. The support surface is a surface of the wheel, which rotates about the vertical axis. At least one magnet arrangement is effective at each carrier surface. This magnet arrangement locates the carried-along closure element during movement between the transfer position and the receiving position.

24 Claims, 2 Drawing Sheets

APPARATUS FOR SEPARATING AND MAKING AVAILABLE CLOSURE ELEMENTS

BACKGROUND OF THE INVENTION

The present invention relates to an apparatus for separating crown corks or similar closure elements and making them available to a receiving position of a closing machine, where a respective one of the closure elements, which is disposed on a support surface of a transport mechanism, is received and carried along by a closing mechanism that moves past over the support surface and, along with a plurality of similar closing mechanisms, is provided on a rotating rotor of the closing machine.

For closing or capping machines for closing or capping containers, especially bottles, with crown corks or caps, it is known (DE-OS 27 34 599) to provide an apparatus with which the crown corks or closure elements, which are supplied via a closure channel from a storage means (cork magazine), are separated and are successively made available to a receiving position, so that closing mechanisms of the closing machine that move past this position can pick up and carry along the closure elements from the receiving position for closing or capping the containers.

For separating and making these closure elements available, the closure elements are successively moved from the transfer position to the receiving position with the aid of a transport mechanism, and in particular by means of carrier members that rotate about a vertical axis. The carrier or abutment surface of each carrier member moves a respective closure element from the transfer position to the receiving position. In so doing, the respective closure element slides along a horizontal support surface that annularly surrounds the vertical axis and does not move along with the carrier members. The carrier members are provided on the periphery of a wheel that is essentially embodied as a disk and rotates about the vertical axis.

One drawback of the heretofore known apparatus is that it is necessary to provide a housing that surrounds the wheel. This housing also forms the support surface for the closure elements, and is necessary at least for a reliable guidance of the closure elements as they are moved from the transfer position to the receiving position. The need for a housing results in a relatively expensive type of construction. Furthermore, very difficult to access areas in the form of slots or gaps result between the housing and the wheel that is provided with the carrier members. Thus, in order to clean the apparatus, the housing must be removed, which represents a not inconsiderable amount of effort. Alternatively, it is at least necessary to immerse the entire transport mechanism into a bath for cleaning purposes, for which purpose it is necessary to lower the transport mechanism. This also implies additional structural effort and/or extra work. Due to the presence of a housing, there furthermore results a relatively high type of construction for the transfer mechanism, so that taking into consideration the small spacing between the support surface and the underside of the closing mechanisms that move past the receiving position, due to the relatively high type of construction of the transport mechanism, which small spacing must be maintained for a satisfactory operation of the apparatus or capper, it is not possible, in order to clean the closing mechanism, to place rinsing or cleaning bells or caps on the underside of the closing mechanisms and to undertake a cleaning while the closing mechanisms rotate, without first having to lower the transport mechanism.

It is therefore an object of the present invention to improve an apparatus of the aforementioned general type in such a way that, while avoiding the aforementioned drawback, an improved manner of operation is possible, in particular also a simplified cleaning, yet a simplified construction is also provided.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
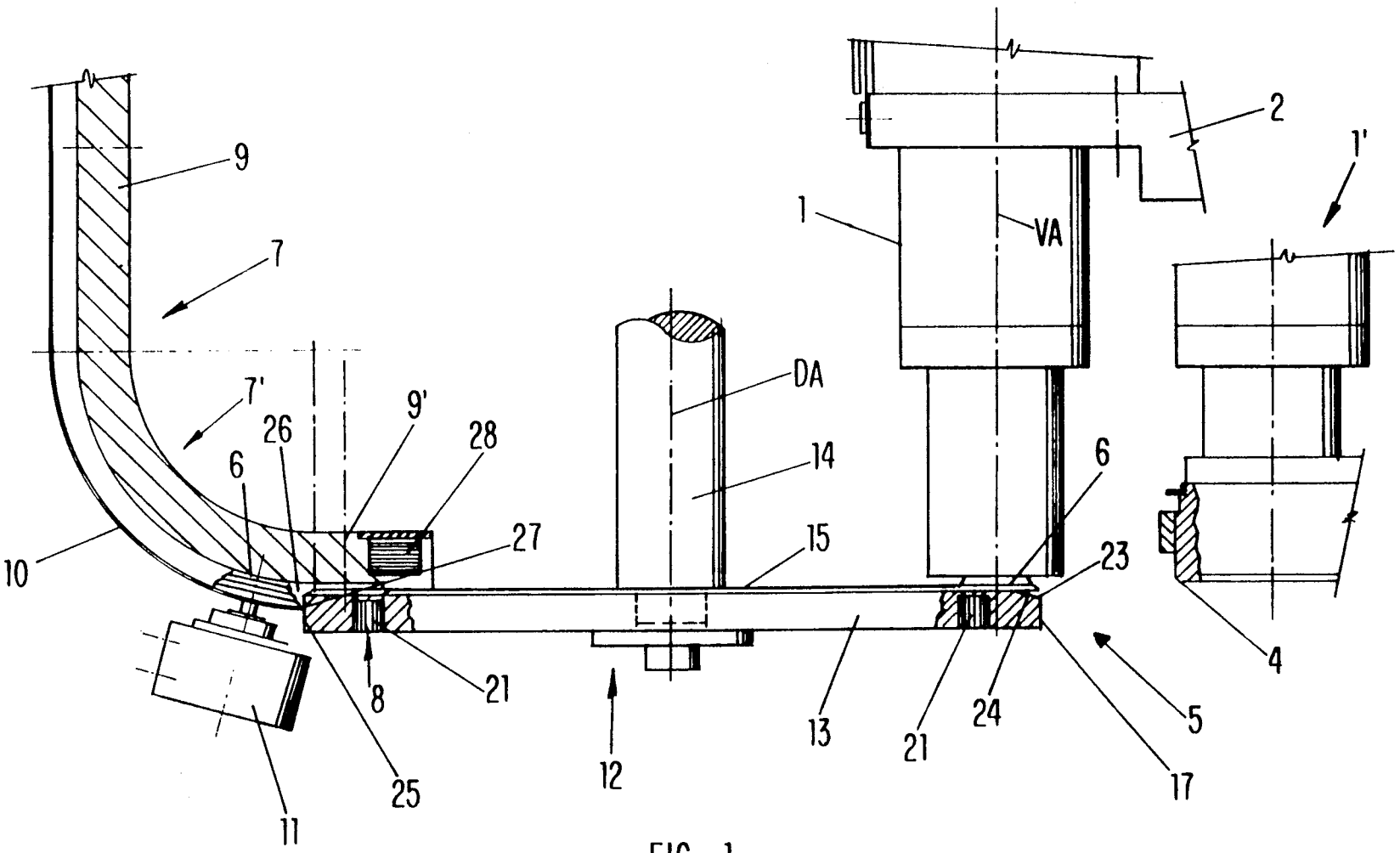
FIG. 1 is a simplified side view of one exemplary embodiment of the inventive apparatus.
Figure 2:
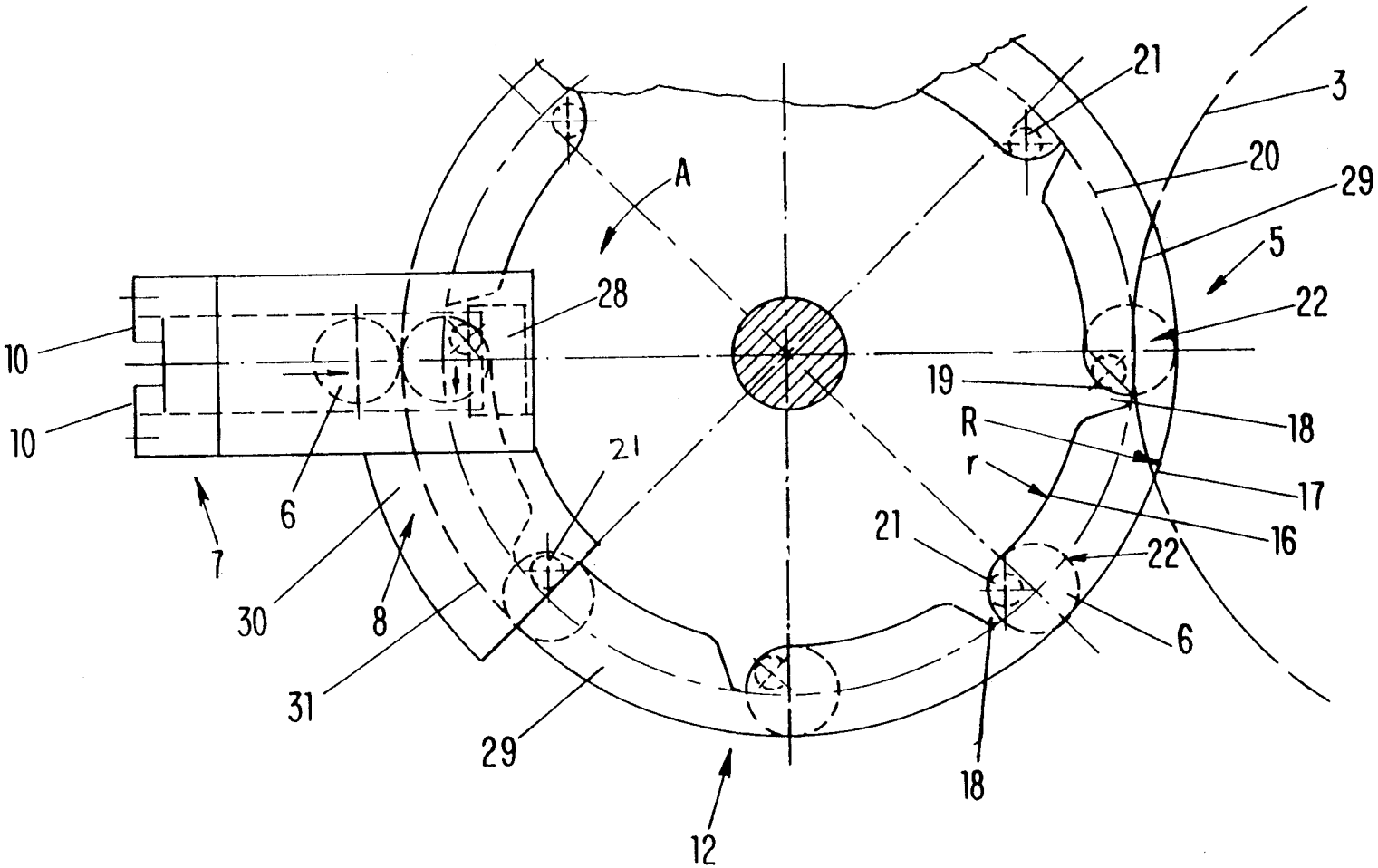
FIG. 2 is a simplified plan view of the apparatus of FIG. 1.

The apparatus of the present invention comprises: Wheel means rotatably driven by a drive means about a vertical axis, in a given direction of rotation, synchronously with a movement of the rotor, the wheel means having a first periphery that concentrically surrounds the vertical axis, the wheel means further itself being provided with the support surface, which, relative to the vertical axis extends radially outwardly from the periphery and surrounds the same; carrier members disposed on the periphery of the wheel means and extending radially beyond the periphery, with a leading side of each carrier member, as viewed in the direction of rotation as well as an adjacent downstream portion of the periphery, forming a carrier or abutment surface for a respective one of the closure elements, the carrier or abutment surface of the carrier member being disposed over the support surface of the wheel means; at least one closure channel that serves for supplying closure elements from a storage means to a transfer position that is formed on the support surface within a zone of movement of the carrier members and is offset from the receiving position relative to the vertical axis, for which purpose the closure channel ends in an opening for releasing closure elements to the transfer position; positioning means disposed at the transfer position for a precise positioning of a respective closure element; and at least one magnet arrangement that is effective at each carrier or abutment surface for holding a respective carried-along closure element against the carrier or abutment surface during movement between the transfer position and the receiving position.

Since with the inventive apparatus the support surface is moved along with the carrier members the closure elements no longer glide along a support surface, thereby for starters avoiding wear and abrasion and hence contamination and an accumulation of dirt due to this abrasion.

Furthermore, it is also possible with the inventive apparatus to dispense with a housing that surrounds the wheel. In other words, the carrier members and the wheel that is provided with the support surface can be fully exposed, so that not only is a simplified construction provided, the possibility of a particularly straightforward cleaning is also provided. Areas that are difficult to access, and in which dirt or bacteria can collect, are avoided.

The magnet arrangement that is effective at each carrier or abutment surface ensures a reliable holding of the closure elements, so that these closure elements cannot become lost as they are transported from the transfer position to the receiving position.

Further specific features of the present invention will be described in detail subsequently.

DESCRIPTION OF PREFERRED EMBODIMENTS

Referring now to the drawings in detail, the reference numeral 1 refers to a closing or capping mechanism that is part of an otherwise non-illustrated crown cork capping machine. The capping mechanism which is of conventional construction, is similarly disposed in a conventional manner, along with a plurality of similar capping mechanisms 1, on a rotor 2 of the capping machine that rotates about a vertical machine axis. As the driven rotor 2 is rotated, the vertical axis VA of each capping mechanism 1 moves about a circular path of movement 3.

Illustrated in FIG. 1 next to the capping mechanism 1 is a further closing or capping mechanism 1', on the bottom end of which is disposed a cleaning or rinsing bell or cap 4 that tightly closes off the underside of the capping mechanism for a cleaning process (cleaning in place or CIP cleaning). It is to be understood that all of the capping mechanisms 1 of the capping machine are respectively provided with a cleaning or rinsing cap 4 during the cleaning, but only during this cleaning, and that during normal operation of the capping machine when bottles or similar containers are being closed or capped, the rinsing bells or caps are removed.

A receiving position 5 is formed along the path of movement 3. At this position, a crown cork or cap 6, with its closed side being disposed up, is always available when a capping mechanism passes this position, so that this crown cork 6 is picked up and taken along by this capping mechanism 1 by a pick-up element, for example in the form of a permanent magnet, that is formed on the capping mechanism.

The crown corks 6, which are provided from a non-illustrated cork magazine, are conveyed via a closure channel 7, and in particular in a prescribed orientation, in such a way that at the end of the closure channel 7, i.e. at a transfer position 8 provided there, the crown corks 6 have a prescribed orientation such that the closed side of the crown corks 6 face up.

The closure channel 7 initially extends downwardly in a vertical direction and in the region of the transfer position 8 has a curved section 7' such that at the transfer position 8 the closure channel 7 has an approximately horizontal orientation. That side of the closure channel 7 against which the closed side of the crown corks 6 rests, is formed by a primary element 9 that is held in a non-illustrated manner on a machine frame of the crown cork capping machine. On that side opposite the element 9, the closure channel 9 is delimited by thin wall members 10 between which a slot is formed. The open side, i.e. the ragged or jagged edge, of the crown corks 6 rest against the wall members 10. Just ahead of the transfer position 8 a blocking means 11 is provided for being able to block the closure channel 7, and hence also the discharge of crown corks 6 from the closure channel, for example upon termination or interruption of the capping process, during disruptions, etc.

With the aid of a transport mechanism 12, the crown corks 6, which closely follow one another in the closure channel 7, are separated and are transported one after the other from the transfer position 8 to the receiving position 5. The transport mechanism 12 comprises, among other things, a wheel or disk 13 that is secured to the underside of a shaft 14. This shaft is mounted on the non-illustrated machine frame of the capping machine in such a way as to be rotatable about a vertical axis DA. The shaft 14, and hence also the disk 13, are driven about the vertical axis DA by a non-illustrated drive means in either a continuously rotating or cyclical manner, and in particular in the direction of rotation A and synchronously with the movement of the rotor 2.

Suitably secured to the upper planar side of the disk 13, which upper side is disposed in a plane that extends perpendicular to the axis DA, is a further disk 15 that is much thinner than the disk 13. Furthermore, the disk 15, which is disposed coaxially relative to the disk 13, has a rim or periphery 16 that is curved essentially in the shape of a circular arc; the radius "r" of the periphery 16 of the disk 15 is less than the radius R of the rim or periphery 17 of the disk 13. The difference between the two radii "r" and R is approximately equal to the diameter of the crown corks 6. The periphery 16 of the disk 15 is provided with a plurality of nose-like carrier members 18 that project radially beyond the periphery 16; these carrier members 18 are distributed at uniform angular spacings about the axis DA, and have a radial length beyond the periphery 16 that is approximately equal to half of the diameter of the open sides of the crown corks 6. The leading edge of each carrier means 18, as viewed in the direction of rotation A, forms for a respective crown cork 6 a carrier or abutment surface 19 that is convexly curved in the shape of an arc of a circle. Each abutment surface 19 extends over an angular range of about 90°, and is partially on the periphery 16, partially on the base of the pertaining carrier member 18 that merges with this periphery, and partially on the leading edge of the carrier member 18, as viewed in the direction of rotation A, that projects beyond the periphery 16.

As the disks 13 and 15 rotate, the free ends of the carrier members 18 move along a circular path 20 that is tangential to the path of movement 3 at the receiving position 5, and along which the central axes of the crown corks 6 essentially also move from the transfer position 8 to the receiving position 5.

A permanent magnet 21 is associated with each carrier member 18. Each permanent magnet 21 is disposed in a recess of the disk 13 that is closed off toward the upper side of this disk in such a way that the permanent magnet is disposed radially within the circular path 20 yet radially outwardly of the periphery 16 and, when viewed in the direction of rotation A, ahead or downstream of the pertaining carrier member 18, i.e. the abutment surface 19 formed thereby, and in particular by a distance that is considerably less than the difference between the two radii R and "r" and approximately in the middle of the respective abutment surface 19.

The carrier members 18, the carrier or abutment surfaces 19 thereof, as well as the pertaining permanent magnets 21 form receiving means 22 for accommodating a respective crown cork 6 during transport thereof from the transfer position 8 to the receiving position 5. During such transport, the open side of each crown cork rests upon the upper side of the disk 13, i.e. upon a support surface 29 thereof; the rim of the crown cork 6 that surrounds the open side thereof rests against the abutment surface 19 and the crown cork is fixed in position by the permanent magnet 21 that is disposed below it in such a way that as the disks 13 and 15 rotate the crown cork 6 cannot become lost, even as a consequence of the centrifugal forces that occur during the transport process. Since the disk 15 is so thin, the upper closed side of the crown cork 6, which is carried along in the receiving means 22, projects relatively far beyond the upper side of the disk 15 and can thus be satisfactorily picked up at the receiving position 5 by a capping mechanism 1 that is moving past that location.

As shown in FIG. 1, the upper side of the periphery 17 of the disk 13 is provided with a beveled portion 23 that merges into the planar upper side of the disk 13, i.e. into the support surface 29, and in particular at an angular zone 24 that concentrically surrounds the axis DA and that has a radius that is somewhat greater than the radius of the circular path 20.

At the transfer position 8, i.e. at the opening 25 of the closure channel 7 provided there, the wall members 10 extend radially to the periphery 17, where the inner surfaces of the wall members 10 are disposed approximately at the same level as is the beveled portion 23 at this periphery 17. As also shown in FIG. 1, a portion 9' of the element 9 extends beyond the opening 25 and is disposed above the wheel formed by the disks 13 and 15. On that side that faces the disk 13, the portion 9' is configured in such a way that, starting from the opening 25, it is first axially spaced from the upper side of the disk 13, i.e. from that portion of the disk 13 that extends beyond the disk 15. Thus, a gap 26 is formed between the disk 13 and the inner surface of the portion 9'. The closure channel 7 opens out into this gap 26, which has a height that is somewhat greater than the axial height of the crown corks 6. Disposed further inwardly, when viewed relative to the axis DA, that surface of the portion 9' that faces the disk 13 forms a stop means 27 for the crown corks 6. Each crown cork 6 rests against this stop means 27 after it has moved through the opening 25 and into a receiving means 22 that has moved past this opening, whereby first that portion of the rim of the crown cork that projects beyond the upper side of the disk 15 rests against the stop means 27. The lengthwise dimension of the portion 9' is essentially oriented radially relative to the axis DA, and that end of the portion 9' that is remote from the opening 25 is provided with a permanent magnet 28, the axis or center of which is, relative to the axis DA, offset radially inwardly relative to the periphery 16 of the disk 15. Whenever a crown cork 6 that is disposed in a receiving means 22 is moved away from the transfer position 8, the permanent magnet 28 moves the first crown cork 6 that is available at the opening 25 through this opening and into the gap 26, where it is held, preferably raised slightly by the support surface 29, until this crown cork can be picked up by the next carrier member 18 in the receiving means 22 formed by the abutment surface 19 thereof and a permanent magnet 21, and is transported away from the transfer position 8.

The apparatus just described is characterized by a particularly straightforward construction, since the transport mechanism 12 essentially comprises only the two disks 13 and 15 along with the pertaining permanent magnets 21, and in particular no housing is needed for enclosing the wheel formed by the disks 13 and 15.

However, this apparatus is characterized not only by a particularly straightforward construction; rather, with this apparatus all of the components, and in particular also the transport mechanism 12, are freely accessible and can therefore be easily cleaned. It is not necessary to first remove a housing in order to be able to clean the transport mechanism 12. It is just as unnecessary to have to lower the transport mechanism 12 in order to immerse it in a bath for cleaning purposes. Furthermore, due to the lack of a housing, and in particular also due to the lack of housing parts that extend over the upper side of the disks 13 and 15, it is also possible to clean the capping mechanisms 1 by placing cleaning caps thereon and rotating the rotor 2, without the need for lowering the transport mechanism 12.

A short, stationary guide means 30 follows the transfer position 8, i.e. the opening 25, when viewed in the direction of rotation A. That side of the guide means 30 that faces the axis DA forms a guide surface 31 that is curved in the manner of a circular arc. The guide surface 31 is disposed approximately in the region of the periphery 17 and hence guides the radial outwardly disposed portion of the periphery of a respective crown cork 6 that is being carried along by a carrier member 18. The guide means 30 additionally ensures that each crown cork or closure element is properly positioned in the receiving means 22 that is formed by a carrier member 18, in other words, in every case the closure element is positioned in such a way that the central axis of the crown cork 6 is disposed upon the circular path 20. In the illustrated embodiment, the guide surface 31 extends over an angular range of the rotational movement A that is somewhat less than 45°. In addition, in the illustrated embodiment the guide means 30 forms a further guide surface for the closed, upper side of the crown cork 6, with this further guide surface being provided above the abutment surface 19 and extending over the same angular range as does the guide surface 31.

The present invention has been described in conjunction with one specific exemplary embodiment. It is to be understood that alterations and modifications are possible without thereby deviating from the inventive concept. For example, it is possible instead of the two disks 13 and 15 to utilize only a single disk, the upper side of which then has the shape formed by the disk 15, i.e. the periphery 16, the carrier members 18, and the abutment surfaces 19 formed thereby, and which, just like the disk 13 with the portion thereof that extends beyond the disk 15, forms the support surface 29 for the crown cork 6 that is carried along.

The present invention is, of course, in no way restricted to the specific disclosure of the specification and drawings, but also encompasses any modifications within the scope of the appended claims.

What I claim is:

1. An apparatus for separating closure elements and for making them available to a receiving position of a closing machine, where a respective one of said closure elements, which is disposed on a support surface of a transport mechanism, is received and carried along by a closing mechanism that moves past over said support surface and, along with a plurality of similar closing mechanisms, is provided on a rotating rotor of said closing machine, said apparatus comprising:

wheel means as part of said transport mechanism, with said wheel means being rotatably driven about a vertical axis, in a given direction of rotation, synchronously with a movement of said rotor, said wheel means having a first periphery that concentrically surrounds said vertical axis, said wheel means further itself being provided with said support surface, which, relative to said vertical axis, extends radially outwardly from said first periphery and surrounds the same;

carrier members disposed on said first periphery of said wheel means and extending radially beyond said first periphery, with a leading side of each carrier member, as viewed in said direction of rotation, as well as an adjacent downstream portion of said first periphery, forming a carrier abutment surface for a respective one of said closure elements, said carrier abutment surface of said carrier member extending beyond said support surface of said wheel means;

at least one closure channel that interconnects a storage means and a transfer position that is formed at said support surface within a zone of movement of said carrier members, with said closure channel serving for the supply of said closure elements from said storage means to said transfer position and being offset from said receiving position relative to said vertical axis, with said closure channel being provided with an opening for releasing said closure elements to said transfer position;

positioning means disposed at said transfer position for a precise positioning of a respective one of said closure elements; and at least one magnet arrangement at each carrier abutment surface for holding a respective carried-along closure element against said carrier or abutment surface during movement between said transfer position and said receiving position.

2. An apparatus according to claim 1, wherein said at least one magnet arrangement in a permanent magnet arrangement.

3. An apparatus according to claim 2, wherein said magnet arrangement is provided on said wheel means.

4. An apparatus according to claim 2, wherein said magnet arrangement comprises a plurality of permanent magnets that are distributed about said vertical axis.

5. An apparatus according to claim 1, wherein the magnetic point of concentration of a respective magnet arrangement is spaced from said carrier abutment surface by a distance that is less than a diameter of said closure elements.

6. An apparatus according to claim 1, wherein said at least one magnet arrangement is disposed at a radial distance from said vertical axis that is less than a radial distance of a radially outermost end of said carrier members from said vertical axis.

7. An apparatus according to claim 1, wherein said wheel means comprises a first disk-like portion having a larger radius and a second disk-like portion having a smaller radius, with said first periphery of said wheel means on which said carrier members are disposed and beyond which the same extend being the periphery of said second disk-like portion, and with a peripheral portion of said first disk-like portion extending beyond said periphery of said second disk-like portion and forming said support surface of said wheel means adjacent to said carrier members.

8. An apparatus according to claim 7, wherein a radially outermost end of said carrier members is disposed at a radial distance from said vertical axis that is less than said radius of said first disk-like portion.

9. An apparatus according to claim 7, wherein the difference between said radii of said first and second disk-like portions is approximately equal to a diameter of said closure elements.

10. An apparatus according to claim 8, wherein the difference between said radius of said first disk-like portion and said radial distance of said radially outermost end of said carrier members from said vertical axis is approximately equal to one half of a diameter of said closure elements.

11. An apparatus according to claim 7, wherein a height of said carrier abutment surface of said carrier member measured parallel to said vertical axis is less than an axial height of said closure elements.

12. An apparatus according to claim 7, wherein said first and second disk-like portions are formed by a first and second disk respectively.

13. An apparatus according to claim 12, wherein faces of said first and second disks rest directly against one another.

14. An apparatus according to claim 7, wherein said first and second disk-like portions of said wheel means are a single piece.

15. An apparatus according to claim 12, wherein said second disk, which is provided with said carrier members, has a thickness that is considerably less than an axial height of said closure elements and a thickness of said first disk.

16. An apparatus according to claim 1, wherein said wheel means is exposed and no housing surrounds said wheel means.

17. An apparatus according to claim 1, wherein at least a portion of said closure channel at said transfer position extends essentially radially relative to said vertical axis.

18. An apparatus according to claim 17, wherein said essentially radially extending portion of said closure channel approaches said support surface of said wheel means radially, relative to said vertical axis, from the outside.

19. An apparatus according to claim 1, wherein said positioning means disposed at said transfer position for a precise positioning of a respective one of said closure elements is provided across from said opening of said closure channel viewed along a line extending radially relative to said vertical axis.

20. An apparatus according to claim 19, wherein said positioning means includes a fixed stop means that does not move along with said carrier means.

21. An apparatus according to claim 20, wherein said positioning means includes a further magnet arrangement that is disposed over said support surface and across from said opening of said closure channel, with a magnetic point of concentration of said further magnet arrangement being disposed radially inwardly of a path of movement about which said carrier members, and the axes of closure elements carried along thereby, rotate about said vertical axis.

22. An apparatus according to claim 21, wherein said closure channel has an end portion that extends from radially outwardly over said wheel means, with at least one of said fixed stop means and said further magnet arrangement being disposed on said end portion of said closure channel.

23. An apparatus according to claim 1, wherein said support surface of said wheel means has a second periphery that is provided with a beveled surface and wherein at said transfer position, said closure channel forms a lower slide surface for said closure elements, said slide surface ending at approximately the same level as a radially outwardly disposed portion of said beveled surface of said second periphery of said wheel means.

24. An apparatus according to claim 1, wherein downstream of said transfer position, as viewed in said direction of rotation of said wheel means, there is provided a short, stationary guide surface means for a radially outwardly disposed part of said closure elements that faces away from said carrier or abutment surface.

* * * * *